US009028346B2

(12) United States Patent
Melin

(10) Patent No.: US 9,028,346 B2
(45) Date of Patent: May 12, 2015

(54) PORTABLE ATHLETIC TARGET

(71) Applicant: Jeffrey V. Melin, Wayzata, MN (US)

(72) Inventor: Jeffrey V. Melin, Wayzata, MN (US)

( * ) Notice: Subject to any disclaimer, the term of this patent is extended or adjusted under 35 U.S.C. 154(b) by 135 days.

(21) Appl. No.: 13/899,793

(22) Filed: May 22, 2013

(65) Prior Publication Data

US 2014/0349786 A1 Nov. 27, 2014

(51) Int. Cl.

*A63B 69/00* (2006.01)
*A63B 63/00* (2006.01)
*A63B 63/06* (2006.01)

(52) U.S. Cl.

CPC ..... *A63B 63/003* (2013.01); *A63B 69/002* (2013.01); *A63B 2209/00* (2013.01); *A63B 63/06* (2013.01); *A63B 2209/10* (2013.01)

(58) Field of Classification Search

USPC ..... 273/378, 384, 398–402; 473/446, 473/476–478

See application file for complete search history.

(56) References Cited

U.S. PATENT DOCUMENTS

| | | | | | |
|---|---|---|---|---|---|
| 4,083,559 | A * | 4/1978 | Owen, Jr. | ..... | 473/197 |
| 4,921,257 | A * | 5/1990 | Heller | ..... | 473/446 |
| 5,181,725 | A | 1/1993 | Leras et al. | | |
| 5,271,624 | A * | 12/1993 | Sciortino | ..... | 473/446 |
| 5,303,914 | A | 4/1994 | Cooksey | | |
| 5,615,889 | A | 4/1997 | Long | | |
| 5,634,640 | A * | 6/1997 | McCarrel | ..... | 473/446 |
| 5,902,194 | A | 5/1999 | Wade | | |
| 5,993,334 | A | 11/1999 | McNamara | | |
| 6,264,572 | B1 * | 7/2001 | Matheson et al. | ..... | 473/446 |
| 6,402,641 | B1 * | 6/2002 | Lee | ..... | 473/446 |
| 6,508,729 | B1 * | 1/2003 | Coltrane et al. | ..... | 473/446 |
| 6,926,624 | B1 * | 8/2005 | Witzke | ..... | 473/446 |
| 7,037,219 | B2 | 5/2006 | Pakieser | | |
| 7,293,776 | B2 * | 11/2007 | Fenwick | ..... | 273/400 |
| 7,407,452 | B1 * | 8/2008 | Gawthrop | ..... | 473/446 |
| 7,811,183 | B1 | 10/2010 | Ohle | | |
| 8,052,545 | B1 * | 11/2011 | Assenheimer, III | ..... | 473/446 |
| 8,187,123 | B2 | 5/2012 | Pettys | | |
| 8,246,494 | B2 | 8/2012 | Stephenson | | |
| 8,262,515 | B2 | 9/2012 | Morris | | |
| 8,317,612 | B2 | 11/2012 | Guthrie et al. | | |
| 8,360,904 | B2 | 1/2013 | Oleson et al. | | |
| 8,376,852 | B2 * | 2/2013 | Kao | ..... | 463/36 |
| 2005/0187037 | A1 | 8/2005 | Campbell et al. | | |
| 2007/0265115 | A1 * | 11/2007 | Farquhar | ..... | 473/446 |
| 2008/0032826 | A1 * | 2/2008 | Mubarak et al. | ..... | 473/446 |
| 2008/0076606 | A1 * | 3/2008 | Siefker | ..... | 473/446 |
| 2008/0214331 | A1 * | 9/2008 | Talafous et al. | ..... | 473/446 |
| 2008/0293522 | A1 | 11/2008 | Kaleel et al. | | |
| 2009/0176603 | A1 * | 7/2009 | Prince | ..... | 473/446 |
| 2014/0087894 | A1 * | 3/2014 | Siefker | ..... | 473/446 |

* cited by examiner

*Primary Examiner* — Mark Graham
(74) *Attorney, Agent, or Firm* — Mark A. Litman & Associates, P.A.

(57) ABSTRACT

A portable fabric target for ball sports has at least:

a) three fabric panels, comprising a top first panel, a middle second panel; and a bottom third panel;

b) the top first panel having i) a first bottom edge attached to at top edge of the second middle panel and ii) a second outside top edge;

c) the top first panel having a support element extending away from the second outside top edge;

d) the support element having a self-latching system that connects the second outside top edge to itself to form a loop or to a section of the top first panel to form a loop;

e) the support element when locked around a pole supporting all weight of the portable fabric target without unlocking; and f) the bottom third panel having a stabilizing component thereon.

7 Claims, 2 Drawing Sheets

PORTABLE ATHLETIC TARGET

BACKGROUND OF THE INVENTION

1. Field of the Invention

The present invention relates to the field of sports practice devices, sports practice devices for use with sports balls, and sports practice devices for use in training with soccer balls.

2. Background of the Art

To succeed in sports, it is essential that players practice on a regular basis. In all types of sports, various practice techniques and systems have been developed to train particular skill sets in the various sports. A vast number of complex devices and systems have been developed to target specific techniques in specific sports. The more complex the system, the more likely that the system is too complex and costly in comparison to the benefits that can be obtained. In some sports, such as golf, the complexity of some equipment has been the object of ridicule, as comically shown in the movie Tin Cup.

Most young players cannot afford the more expensive training systems promoted in their particular sports, even if they provided some genuine benefit. Many of the systems are also complex to set up and cannot be positioned or used by smaller children. The simplest available practice devices for soccer, however, offer little reward during practice and therefore cannot maintain the player's interest for significant time. Among the published sports practice systems that can be used for soccer practice are the following U.S. Patents and Patent Applications.

U.S. Pat. No. 8,360,904 (Oleson) describes a sports electronic training system with sport ball, and applications thereof. In an embodiment, the system comprises at least one monitor and an electronic processing device for receiving data from the at least one monitor and providing feedback to an individual based on the received data. The monitor can be a motion monitor that measures an individual's performance such as, for example, speed, pace and distance for a runner. Other monitors might include a heart rate monitor, a temperature monitor, an altimeter, et cetera. In an embodiment, a sport ball that includes a motion monitor for monitoring motion of the sport ball stores an identification value received when a shoe that includes a motion monitor contacts the sport ball. The stored identification value serves as a record of the contact.

U.S. Pat. No. 8,317,612 (Guthrie) provides a net or barrier that has strategically located pocket(s) attached to the net over holes(s) in the net/barrier in order to catch a ball or projectile that passes through the hole(s). A computer-assisted method displays information, more particularly advertisement, onto a net or barrier. The computer-assisted display is viewable by a TV or video audience.

In U.S. Patent Application Publication No. 20050187037, a sports training target system is disclosed. The system includes a target anchor having a support post that includes a slight angle in the forward direction. The system includes a target section having at least one target arm which is rotatably secured to the anchor support post. When a ball is thrown by a pitcher and it strikes the target arm, the target section will partially rotate around the anchor support post. The angle in the support post, together with gravity, will force the target section back to its original position facing the user.

In U.S. Patent Application Publication No. 20080293522 (Kaleel), a freely positionable tennis court practice target has a plurality of areas each of which generates a signal when impacted by a ball. A counter-display is responsive to signals from each area to numerically display the number of hits to each area. Lights and/or speakers may be included to provide an indication when each target area is impacted.

U.S. Pat. No. 8,187,123 (Pettys) describes a portable target to enable an individual to practice kicking soccer balls through what is considered the most difficult location for a goal tender to guard against. A portable target for a soccer goal designed with rods that enable an individual to stand on the ground and lift the portable target so that it can be lifted over the top horizontal crossbar of the soccer goal and then set in place. The target has elongated rods with curved hook attaching members designed in a manner that enables an individual to stand on the ground and simply lift the target so that the curved hook attaching members can be extended over the top horizontal crossbar of a soccer goal and then lowered onto the top horizontal crossbar of a soccer goal to be removably affixed thereto. The rods are removably retained within interior channels within the target.

U.S. Pat. No. 8,262,515 (Morris) discloses apparatus, systems, and methods for aiding a user in learning and practicing techniques for performing a volley kick of a soccer ball. A volley kick training apparatus, as disclosed herein, is configured to position and hold a soccer ball to simulate to a user the scenario of kicking a soccer ball while in mid air to perform and achieve the volley kick.

U.S. Pat. No. 7,811,183 (Ohle) describes a ball kicking-training apparatus that has a base which vertically supports a post having a rotatable axle whose top end is provided with a ball and socket device. The ball component of the ball and socket device is attached to an arm whose opposite end is attached to the ball to be kicked by the user of the apparatus.

U.S. Pat. No. 5,303,914 (Cooksey) provides an upright standard including a plurality of horizontally outwardly projecting vertically spaced support arms journaled from the sleeve for rotation thereabout, the outer ends of the support arms including target members thereon for striking by a bat-like member. The upright is removably supported from a base structure including depending ground impaling blades and the support arms are mounted from the upright upon sleeves journaled from the upright and including weight means on the sides thereof opposite the sides from which the support arms project in order to enable the support arms to rotate about the upright in a substantially balanced manner.

U.S. Pat. No. 8,246,494 (Stephenson) discloses a soccer training apparatus comprises a net capable of being placed in a deployed position, connected to or located adjacent a soccer goal frame and above a soccer playing surface, so as to cover a portion of a target opening bounded by the soccer goal frame and soccer playing surface. The net includes a peripheral edge located relative to the soccer goal frame so as to form a gap which extends around the net in the deployed position which permits a soccer ball to pass through and enter the soccer goal area.

U.S. Pat. No. 7,037,219 (Pakieser) discloses a soccer training device that has a net which covers the large central portion of a soccer goal but leaves limited openings in the upper corners of the goal as well as along each opposite side of the goal which are relatively harder for a goal tender to block. The objective is to train and teach soccer players to kick or otherwise lawfully propel the soccer ball through those relatively harder portions of the goal for a goal tender to block, thereby increasing the likelihood of being able to score.

U.S. Pat. No. 5,993,334 (McNamara) describes a practice backdrop for hockey and other sports that includes a flexible backdrop sheet, e.g. vinyl plastic impregnated cloth. Connectors support the backdrop sheet from its upper edge. An impact-dampening weight is connected to the backdrop sheet near its lower edge to help the backdrop sheet absorb the impact of a hockey puck or ball which strikes it. A removable and replaceable target sheet that has a frontal area which is smaller than the backdrop and can be formed from cloth is overlaid against the front surface of the backdrop to serve as an object for a player to shoot at and to help cushion the impact of shots fired at the backdrop. Lifting cords elevate and simultaneously fold both the backdrop and target into contiguous horizontally extending accordion folds in which horizontal folds of the target are lapped between horizontal folds of the backdrop material.

U.S. Pat. No. 5,902,194 (Wade) discloses a particularly flexible soccer goal target that can be formed by using a plurality of fasteners or clips to attach together a plurality of strips of netting into a target assembly. The plurality of strips of netting are fastened or clipped together, edge to edge, to form a net assembly having sufficient width and height to extend across a substantial portion of the entrance of the soccer goal. The strips of netting, which are fastened or clipped together to form the target assembly, may be easily disconnected by unclipping them at different locations of the goal entrance to provide openings in the target assembly at different positions in the goal that will serve as targets for practice. Further, both the soccer net and flexible soccer goal may be provided at their peripheries with a plurality of spaced permanently attached cord-formed attachment means.

U.S. Pat. No. 5,615,889 (Long) describes a portable and lightweight soccer practice net that can be quickly attached to and removed from an existing soccer goal frame by one person. The net consists of a generally non-elastic material with webbing straps attached to its perimeter to strengthen the edges of the net. By adjusting the tension in the webbing straps, the tension of the net may be varied to allow different soccer drills to be practiced. The practice net is capable of withstanding high tension forces in excess of 350 pounds to rebound soccer balls at nearly the same speed with which they strike the practice net.

U.S. Pat. No. 5,181,725 (Leras) describes a soccer shooting training target which may be easily rolled up and transported and which can be installed over an existing soccer goal. The target comprises a plurality of individual targets containing flaps sized to admit passage to a soccer ball. The soccer shooting training target's upper edge is tied in place to the goal rear crossbar using a weighted rope. The bottom corners of the soccer shooting training target are tied down using elastic cord and stakes in order to render the target stable in the presence of wind. Alternate soccer shooting training target configurations include a stand mounted free standing version and a canister housed target permanently mounted to a soccer goal crossbar.

These and even more complex systems known in the art can still be improved upon, even adding simple constructions that can engage users for longer periods of time. The components, materials and systems of the references cited herein are incorporated by reference in their entirety.

SUMMARY OF THE INVENTION

A portable fabric target for ball sports has at least a) three fabric panels, comprising a top first panel, a middle second panel; and a bottom third panel;

b) the top first panel having i) a first bottom edge attached to at top edge of the second middle panel and ii) a second outside top edge;

c) the top first panel having a support element extending away from the second outside top edge;

d) the support element having a self-latching system that connects the second outside top edge to itself to form a loop or to a section of the top first panel to form a loop;

e) the support element when locked around a pole supporting all weight of the portable fabric target without unlocking; and f) the bottom third panel having stabilizing components thereon optionally including a grommet to allow for using a stabilizing weight, which may be secured by an elastic retainer such as a bungee or a cord to secure the panel to the bottom of the goal post and a "pouch" to allow for a weight, i.e. a "sand sock" to be inserted in order to help keep the entire product in place during windy conditions and when the product is hit by a shot.

g) There may also be also a loop attached to the top of the first panel that helps secure the "Velcro" and deflect (absorb) the pressure of a shot.

DETAILED DESCRIPTION OF THE INVENTION

Figure 2:
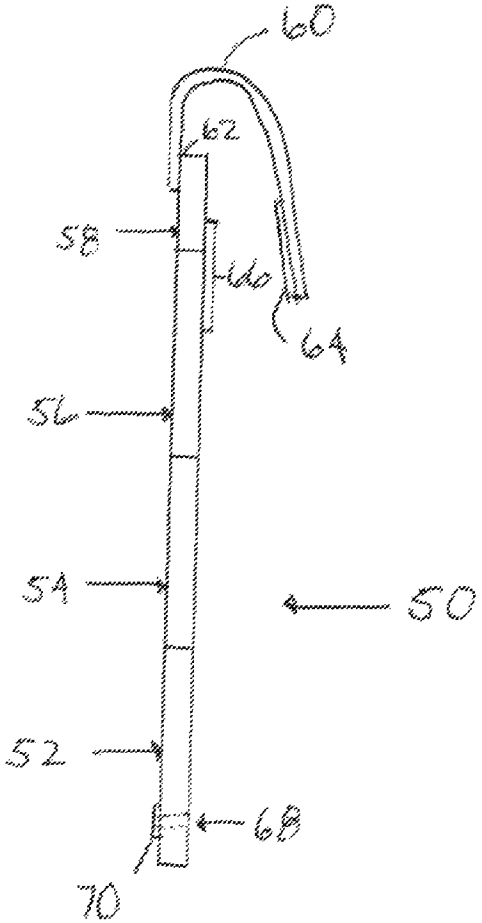
FIG. 2 is a side view of a portable fabric target.

A portable fabric target for ball sports has at least:

a) three fabric panels, comprising a top first panel, a middle second panel; and a bottom third panel;

b) the top first panel having i) a first bottom edge attached to at top edge of the second middle panel and ii) a second outside top edge;

c) the top first panel having a support element extending away from the second outside top edge;

d) the support element having a self-latching system that connects the second outside top edge to itself to form a loop or to a section of the top first panel to form a loop;

e) the support element when locked around a pole supporting all weight of the portable fabric target without unlocking; and f) the bottom third panel having a stabilizing component thereon.

The target may have each panel permanently or temporarily secured to adjacent panels. Permanent attachment could be a single fabric with differently dyed sections; different fabrics stitches of adhesively secured and the like. Each panel may have a different color from each other panel. The three fabric panels may be aligned along a length, forming a left side and a right side. An attached element on at least an edge along the left side or right side may be capable of being dislodged from a side when the attached element is struck by a ball having a mass of at least 50 grams moving at a speed of between 2-20 meters/second.

In the target, the attached element may be a fabric that is removeably secured to the left or right side. Fabric fasteners (e.g., Velcro™ fasteners, and the like), pressure-sensitive adhesives, snaps and the like may be used for removable attachment. The attached element, particularly with the fabric attaching systems, may be brush-like and may contain visible powder and even color powder (matching colors in the various panels). When the attached element is struck, the powder may be powered out of the brush to indicate the precise panel (or combination of panels) by color differentiation, and the powder may transfer to the ball, so that the color transferred to the ball would indicate which panel was struck. The use of this color indication for strikes on different panels (and even different portions of the panel by varying colors along the width of the panels as well as the different panels themselves) can increase the enjoyment of target shooting by offering the entertainment of the color powder release. Alternatively or additionally, pressure sensitive sheets or fabric lock sheets may be secured to a major face of the panels and the attached sheets have transferable color on an exposed surface. Paper sheets with dried finger paint may even be used, as the finger paints are inexpensive, players may use their own colors, and the finger paints will readily wash off the surface of the balls, such as softballs or soccer balls.

The target may provide at least one panel in which at least one of the different colors is transferable to an object when the object strikes at least a portion of the at least one panel and the object has a mass of at least 50 grams moving at a speed of between 1-20 meters/second. The transferable color may be a dry pigment that temporarily transfers onto the surface of the object.

The target may use a stabilizing component of a grommet in the third bottom panel and a string/cord passing through the grommet. The cord/bungee, may also be attached to the bottom of the goal post to a pointed stake that can be embedded in the ground to stabilize the target through the bottom third panel. The stabilizing component may alternatively or jointly include at least one weight distributed on the third bottom panel. The bottom panel will include a pouch whereas a weighted object i.e. a sand sock can be placed to aid in stabilizing the overall panel after a shot has hit the target or to help maintain its position in a wind. The target will be used with the securing system is locked about a horizontal pole. The pole may be a soccer net horizontal bar or may be a bar supported by a vertical post.

Figure 1:
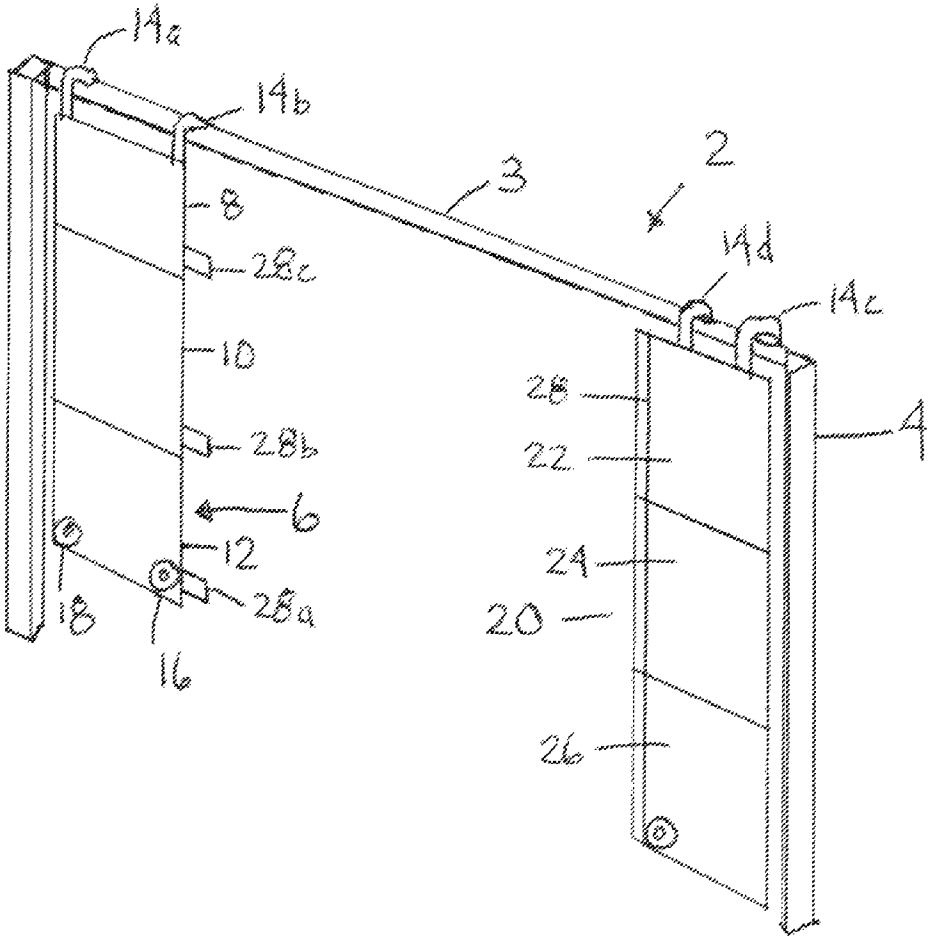
FIG. 1 is a perspective view of a sports frame with two portable fabric targets hung over the frame.

A review of the Figures will assist in a further understanding of the present invention. FIG. 1 is a perspective view of a sports frame 2 with two portable fabric targets 6 and 20 hung over the top bar 3 of the frame 2. The left portable fabric target 6 is shown with three separate and distinct color vertical panels 8, 10 and 12. Two connector or support systems 14*a* and 14*b* are attached to the top panel 8 and support the entire left portable fabric target 6 from the top bar 3. The panels 8, 10 and 12 may be made of the same or different fabric materials, but each fabric material should be impact durable (to sustain repeated strikes by a sports object and subjection to outdoor conditions. The fabric panels may be permanently secured together or may be separable and reattachable upon impact. Velcro™ fasteners or other detachable fasteners (even adhesive) may be used to attach the panels. Natural and synthetic fabric material such as polyamides (e.g., nylons), polyesters, cotton, wool, silicone polymers, polyurethane polymers, fluorinated polymers, blends of fabric materials and the like. The panels may be colors (e.g., red, orange, yellow, green, blue, indigo or violet (and shades, patterns and combinations thereof) or shades of the same color or tone (e.g., black, charcoal, grey, white, etc.). The fabric weight should be at least about 3 ounces per square foot, up to a pound or more per square foot. The fabric is preferably not water absorbent, although it may be porous (1 as with woven fabrics). The "fabric" may be a polymeric sheet, a polymer coated fabric, or a rubberized fabric material). There is a pair of grommets 16 and 18 shown on the bottom panel 12. The grommets 16 and 18 may be used with additional common tools and equipment (not shown) such as ties, cords, rope, string, cables, strings and stakes, cords and hooks, and the like. The equipment may be used through a connection with the grommet to be attached to the ground and/or to the frame 2. Tabs 28*c*, 28*b* and 28*a* are attached to a side of the panels 12, 10 and 8, respectively. These tabs may readily detach from the panels when struck, may have a powder on them that is released in a puff when struck, or have transferable (and replaceable) color on them that will transfer to a sports object when they strike the tabs. The location of the tabs and the size of the panels are useful in improving accuracy with the sports object. Powders may be applied to the surface of the tabs (or even to the panels themselves) and readily replaced. This may be done by spraying non-absorbed liquid materials onto the panels or tabs and drying them (or not) so that the powder (or liquid) will transfer to the sports object. The tabs may be snapped into place, adhesively secured, fabric interlocking systems used (Velcro™ connectors), and the like.

The right side portable fabric target 20 also is shown with three panels 22, 24 and 26 adjacent right support pole 4. On the inside edge of the target 20 is an edge strip 28 that may be either a solid state audio emitter or solid state visual (light) emitting system. There are pressure sensitive sensors in the edge strip 28 that activate either an audio system of light system. Different sounds or different colors will be emitted upon a sports object striking the edge strip 28. Different sensors along the strip 28 provide different signals to the final (audio or light) emitter, and the appropriate (audio or light) response is emitted. Support system 14*c* and 14*d* also are used to support the right side fabric target 20.

FIG. 2 is a side view of a portable fabric target 50. This target 50 is shown with four panels 52, 54, 56 and 58. A strap 60, connected to the portable fabric target 50 at a connection point 62 (as by stitching, snaps, fusion or other mechanical fasteners) extends to a distal end with a connection element 64 (e.g., snaps, fabric connector, ties and the like). The strap 60 would wrap around a top bar and support the target 50. An engaging element or surface 66 on the back of the target 50 is shown. Another grommet 70 and the hole 68 passing through the grommet and the target 50 is also shown.

Figure 3:
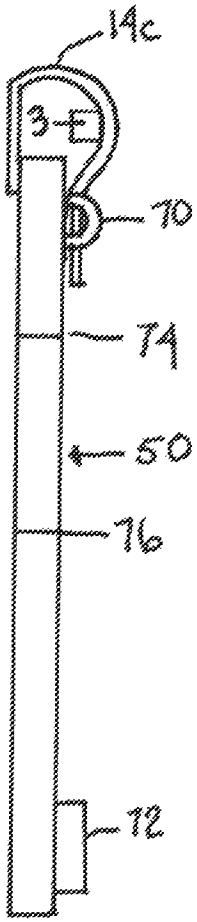
FIG. 3 shows a side view of the fabric target secured to the top of the frame.

FIG. 3 shows a side view of the fabric target 50 secured to the top bar 3 of the frame 2 (not shown in this figure). Support system 14*c* is shown wrapped over the top bar 3 and a loop 70 stabilizes the support system 14*c* against impact from the strike of the sports object. A secured sandbag weight 72 is shown at the bottom of the fabric target. This weight 72 helps stabilize the target 50 upon impact. The panels may be separable upon impact or for storage along panel joining lines 74 and 76.

The target may be used for many different sports. Although football or soccer is the most obvious sport for use of the target(s), other sports may be practiced. Individual players will kick the ball(s) at the targets and identify where the target has been struck by the ball. Different widths of targets may be used to improve accuracy, or the target may be folded on itself to make it thinner. By having specifically located targets (e.g., at the extreme sides of the goal), specific position accuracy can be improved. The apparatus/product allows for players to visualize and shoot at an area of the goal that would increase accuracy in shooting and at an area that would optimize scoring. The apparatus would also allow for players to identify optimum areas of the goal to shoot at. Even without a goal keeper present, a player could evaluate the accuracy and effectiveness of a shot. The same principles may be practiced with thrown footballs (changing the angle of the throw from a specific passer position), softball or baseball pitching, water polo throwing, tennis service and the like.

What is claimed:

1. A portable fabric target for ball sports comprising:

a) three fabric panels, comprising a top first panel, a middle second panel; and a bottom third panel;

b) the top first panel having i) a first bottom edge attached to a top edge of the second middle panel and ii) a second outside top edge;

c) the top first panel having a support element extending away from the second outside top edge and having a length sufficient to wrap around a soccer goal top bar;

d) the support element comprising two separated elements each having a self-latching system that connects the second outside top edge to itself to form a loop or to a section of the top first panel to form a loop;

e) the support element when wrapped and locked around a pole supporting all weight of the portable fabric target without unlocking; and f) the bottom third panel having a stabilizing component thereon, wherein each panel is permanently secured to adjacent panels, and wherein each panel has a different color as compared to each other panel, wherein the target provides at least one panel in which a colored substance is transferable to an object when the object strikes at least a portion of the at least one panel and the object has a mass of at least 50 grams moving at a speed of between 1-20 meters/second.

2. The target of claim 1 wherein the target provides at least one panel with the colored substance having a color corresponding to the color of the at least one panel.

3. The target of claim 1 where the transferable color comprises a dry pigment that temporarily transfers onto the surface of the object.

4. The target of claim 2 where the transferable color comprises a dry pigment that temporarily transfers onto the surface of the object.

5. The target of claim 2 wherein the support element is locked about a horizontal pole that is a top bar of a soccer goal.

6. A portable fabric target for ball sports comprising:

a) three fabric panels, comprising a top first panel, a middle second panel; and a bottom third panel;

b) the top first panel having i) a first bottom edge attached to a top edge of the second middle panel and ii) a second outside top edge;

c) the top first panel having a support element extending away from the second outside top edge;

d) the support element having a self-latching system that connects the second outside top edge to itself to form a loop or to a section of the top first panel to form a loop;

e) the support element when locked around a pole supporting all weight of the portable fabric target without unlocking; and f) the bottom third panel having a stabilizing component thereon, wherein each panel is secured to an adjacent panel and has a different color as compared to each other, wherein the three fabric panels are aligned along a vertical length, forming a left side and a right side of the portable fabric target, and a removably attached element on at least an edge along the left side or right side is capable of being dislodged from a side when the attached element is struck by a ball having a mass of at least 50 grams moving at a speed of between 2-20 meters/second, and wherein the attached element comprises a fabric component that is removably secured to the left or right side, and wherein the attached element is removably secured by a temporary fastening system comprising locking fabric elements, snaps or clips.

7. The target of claim 6 wherein each panel is permanently secured to an adjacent panel.

* * * * *